United States Patent [19]

Thomas

[11] 4,291,621

[45] Sep. 29, 1981

[54] ADAPTABLE STENCIL FOR DIFFERENT MIMEOGRAPH MACHINES

[76] Inventor: Charles F. Thomas, 2000 Skyrock Rd., Loveland, Colo. 80537

[21] Appl. No.: 945,482

[22] Filed: Sep. 25, 1978

[51] Int. Cl.[3] ..... B41F 15/00; B41L 13/00

[52] U.S. Cl. ..... 101/114; 101/127; 101/128.1; 283/1 A

[58] Field of Search ..... 101/114, 127–128.1; 402/79; 46/157, 1 L; 283/1 R, 1 A

[56] References Cited

U.S. PATENT DOCUMENTS 1,247,308 11/1917 Meuser ..... 101/128.1

2,201,953 5/1940 Dalton ..... 101/128.1

3,878,638 4/1975 Benjamin ..... 46/1 L 3,970,397 7/1976 Armstrong ..... 402/79

FOREIGN PATENT DOCUMENTS 2809929 9/1978 Fed. Rep. of Germany ... 101/127.1

*Primary Examiner*—J. Reed Fisher

*Assistant Examiner*—A. Heinz

*Attorney, Agent, or Firm*—Richard D. Law

[57] ABSTRACT

A mimeograph stencil having a plurality of headers secured together by perforated lines permitting removal of the portion not required by the mimeograph duplicating machine.

4 Claims, 5 Drawing Figures

ADAPTABLE STENCIL FOR DIFFERENT MIMEOGRAPH MACHINES

In the art of reproductions, mimeographing is an old well established procedure. This requires a stencil, on which is formed that which is to be reproduced, e.g. writings, drawings, etc. The stencil is prepared and then fastened to the drum holding the stencil for inking and transferring the desired indicia to reproduction paper. A number of different manufacturers produce mimeograph machines, such as A. B. Dick Corp., Gestetner Corp. etc. Each company has its own pin arrangement for holding the stencil in position on the drum. For this purpose, the stencil has a heading (a reinforced top sheet portion) which is punched with holes corresponding to the pins on the mimeograph drum.

Some six companies produce over 90% of the mimeograph equipment sold in the U.S., and several types of stencils may be used with each machine, e.g. different sizes, different grades etc. of stencils. Thus, a supplier of stencils must stock over 50 different stencils to be able to satisfy the customers of an area.

THE PRESENT INVENTION

According to the present invention, there is provided a mimeograph stencil with a heading having multiple lines of pin aligning holes adaptable to a number of different makes of mimeograph machines, with the individual lines being divided by perforation lines permitting removal of the outer headings not usable in the particular machine being used. The body of the stencil is imprinted with guide lines registering the area for the matter to be printed with the heading for each type of machine. This substantially reduces the number of different stencils which must be stocked by a supplier, and substantially reduces the cost of manufacturing, stocking and using.

OBJECTS AND ADVANTAGES OF THE INVENTION

Among the objects and advantages of the invention is to provide a multiple machine usable mimeograph stencil.

Another object of the invention is to provide a stencil having a heading with multiple lines of holding pin holes separated by perforations permitting removal of outer unnecessary holding pin holes for a particular machine.

Still another object of the invention is to provide a mimeograph stencil having individual lines of holding pin holes for use in multiple types of mimeograph machines and having a stencil body imprinted with guide lines corresponding to the headings.

Yet another object of the invention is to provide a multi-machine stencil having plural holding pin holes, aligned between perforation lines permitting removal of outer unused line headings, and arranged so that a single stencil is usable in a majority of mimeograph machines in current use.

These and other objects and advantages of the invention may be ascertained by reference to the following description and appended illustrations.

GENERAL DESCRIPTION OF THE DRAWINGS

SPECIFIC DESCRIPTION OF THE DRAWINGS

Figure 1:
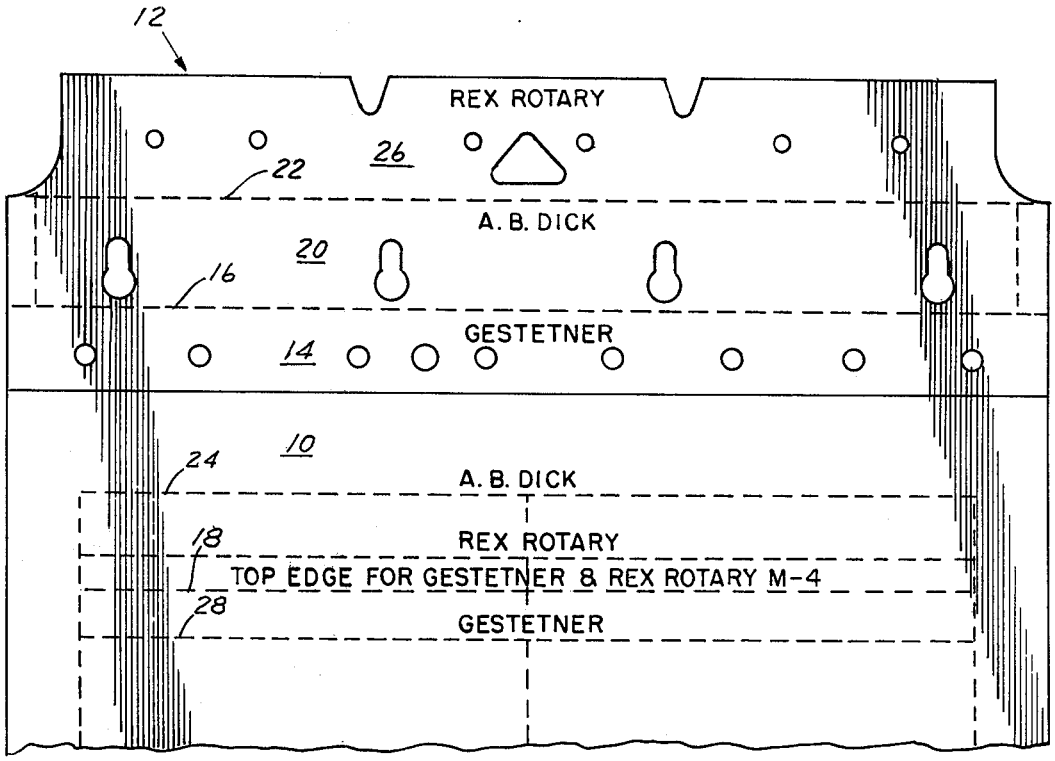
FIG. 1 is a plan view of a mimeograph stencil according to the invention, having a heading with plural holding pin hole lines separated by perforated lines.

In the modification of the invention of FIG. 1, a mimeograph stencil includes a stencil body 10 (normally including overlayed backing sheet, stencil sheet and thin cover sheet, only the cover sheet being shown) and heading, shown generally by numeral 12. The heading generally includes an extension of the backing sheet normally strengthened by one or more additional sheets adhered to the backing extension for strength particularly when the heading is punched to provide a line of holes which fit over the holding pin of the rotary drum of the mimeograph machine. The stencil and stencil cover sheet are adhered by cement or glue to the backing sheet along their head adjacent the heading. The adherence strip is normally narrow and the remainder of the stencil and cover sheets are loose. The stencil and/or cover sheet is over printed with top and side guide lines and other markings and printings for containing the written matter to be reproduced within certain boundaries (determined by the print paper size so as to register the written matter on the mimeograph drum for alignment on the paper being imprinted). Such markings are essentially standard as related to the heading and markings for a particular mimeograph machine. Thus, a mimeograph stencil for an A. B. Dick machine, for example, has the imprinted markings spaced from the pin holes so as to place the material to be printed in the correct position on the mimeograph drum for mating with paper to be printed on. The illustrated stencil body includes four lines of horizontal printing indicating the top printing line of the machines as marked, and these are related to the holes in the heading.

The heading 12 includes a row 14 of round holes, which row is marked Gestetner. This indicates the holes are arranged for the pins on a drum of a Gestetner machine. A row of perforations 16 permits the upper unneeded part of the heading to be removed when the machine available is a Gestetner. For the stencil body, the written material must be below the second imprint line 18, which is indicated as the top edge of the Gestetner or the Rex Rotary mimeograph machines. The line 18 is for registering with the top edge of the print paper, and the written matter to be printed is cut in the stencil below line 28 for aligning printed matter on the print paper.

A heading line 20 includes holes of general pear shape and are four in number spacedly across the heading. This heading section is bounded on the top by a perforated line 22. This heading section is used for A. B. Dick machines and the top section is removed along perforated line 22. The stencil body includes imprint line 24 indicating the top edge of the printing for the stencil body, and is marked for the A. B. Dick machine.

The upper section 26 includes a plurality of holes arranged to fit the pins on the drum of a Rex Rotary mimeograph duplicating machine. The stencil has an imprinted line 28 indicating the upper limits of the printing for this type of machine.

The perforated lines permits the removal of the outer heading portions not needed. Thus, for a Gestetner, the two outer sections 20 and 26 are removed. The printing area on the stencil body then is shown by the imprinted guide lines. For using after the stencil is printed, written or marked on, the cover sheet is removed and the stencil placed on the inking drum, with the holes in the heading over the pins on the drum, in standard practice. Each row of holes for a particular mimeograph on the heading is coordinated with guide lines, imprinted on the stencil, so as to register the stencil area to be cut with the paper area to be imprinted.

Figure 2:
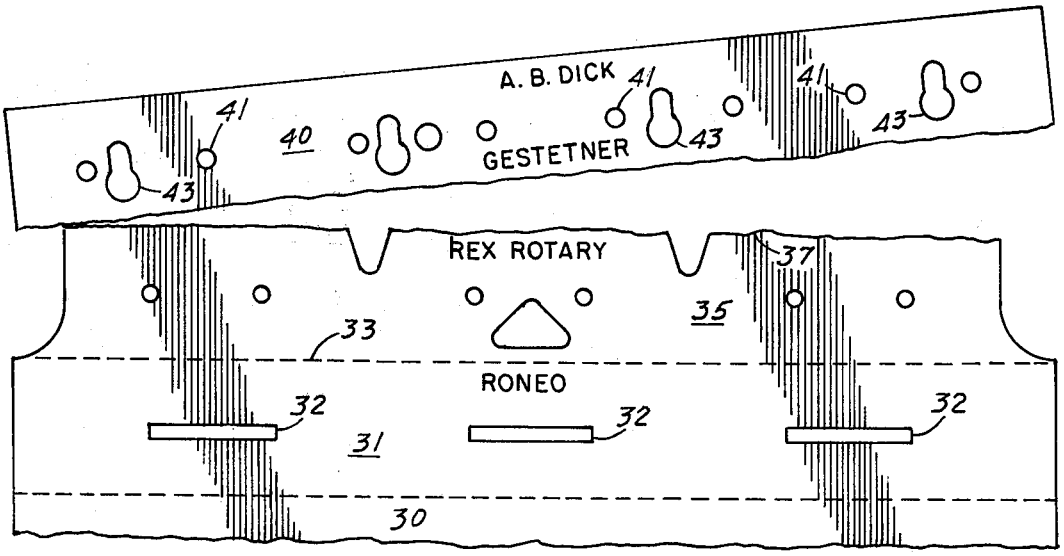
FIG. 2 is a plan view of a modified heading of a mimeograph heading with one line of holding pin holes being removed along a perforated tear line.

In FIG. 2 a stencil body 30 (partially shown) has a heading 31 with a series of rectangular shaped pins of a drum in a Roneo mimeograph machine. A perforated line 33 permits the removal of the remainder of the heading if not required. A second section 35 is arranged with a series of round holes, a triangular hole and edge cut out arranged for the holding pins of a Rex Rotary machine. A perforated tear line 37 permits removal of the outer heading section. This section 40 includes a series of round holes 41 spaced across the sheet, and a series of four pear shaped holes 43 interspaced between the round holes. The round holes fit the holding pins of the Gestetner mimeograph machine and the pear shaped holes fit an A. B. Dick machine. Thus, for using the stencil with either of these two, the heading remains intact. The stencil is then filled out within the boundary lines marked on the stencil, identified for either machine. Of course, for either the Rex Rotary or the Roneo, the outer section or sections must be removed.

Figure 3:
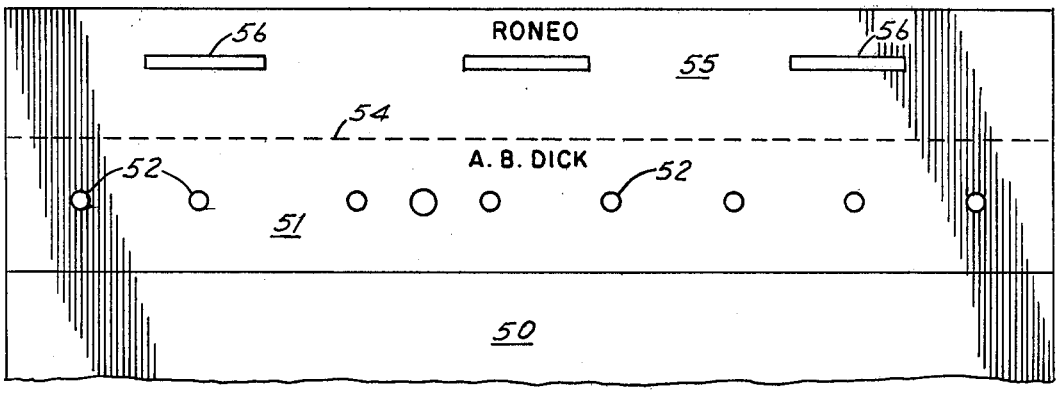
FIGS. 3 and 4 are modified forms of a mimeograph stencil heading, each having two lines of holes separated by a perforated tear line; and, FIG. 5 is a further modified mimeograph stencil heading having three lines of holes with adjacent lines separated by a tear line of perforations.
Figure 4:
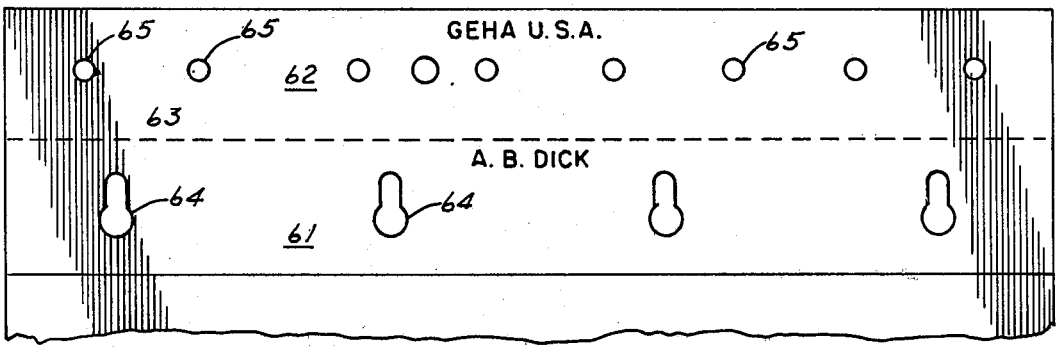

A two heading unit is FIG. 3 where a stencil body 50 includes a heading section 51 separated from an outer heading section 55 by a perforated tear line 54. The section 51 includes a series of round holes 52, arranged for an A. B. Dick mimeograph machine, while the section 55 includes holes for a Roneo drum. The double heading sections of FIG. 4 include sections 61 and 62 separated by tear line 63, and both mounted on a body 60. Section 61 includes pear shaped holes 64 for an A. B. Dick machine, while section 62 includes round holes 65.

Figure 5:
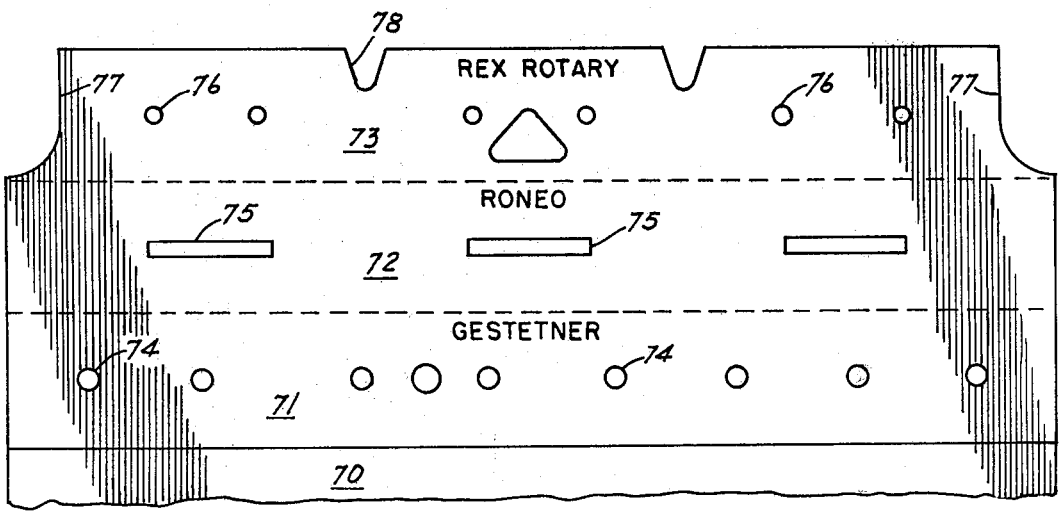

A three section heading is shown in FIG. 5 which includes a body 70, sections 71, 72 and 73. Section 71 includes Gestetner holes 74, section 72 includes Roneo holes 75 and section 73 includes holes 76, side cutouts 77 and end cutouts 78 of a Rex Rotary machine.

Many different arrangements are possible in positioning and number of heading sections. The configuration of FIG. 1 will be adaptable to over 50% of the mimeograph duplicating machines currently in use. Thus, except for size, color and quality, the number of stencils normally stocked for these three machines will be reduced to about $\frac{1}{3}$.

What is claimed is:

1. A mimeograph stencil having an elongated heading portion secured to a stencil body portion at one end of a lengthwise extent of said stencil body portion, said heading portion providing a means for holding the stencil in one of a plurality of different brands of duplicating machines, said heading portion comprising:

a plurality of separate and lengthwise spaced lines of laterally aligned holding pin holes, each line comprising a different series of laterally spaced pin holes sized and positioned so as to hold said heading portion in a different one of said duplicating machines, each of said spaced lines formed in adjacent, separate lengthwise spaced areas of said elongated heading, tear line means for removing a part of said heading portion from the remainder of said heading portion secured to said stencil body, said tear line means comprising a single perforated tear line extending laterally across said heading portion and between each of said adjacent, separate lengthwise spaced areas, permitting one or more of said spaced, pin hole lines to be tearingly removed from said stencil, and a series of stencil cutting guide lines positioned on said stencil body portion for defining boundaries within which the written matter should be imprinted on the stencil body, said heading portion and stencil body having markings which designate a respective certain one of said series of stencil cutting guide lines to be utilized for a given respective line of holding pin holes whereby said stencil cutting guide lines coordinate each particular line of holding pin holes with one of said series of stencil cutting guide lines for a particular duplicating machine so as to provide correct positioning of written matter on print paper for that particular duplicating machine.

2. The improvement of claim 1, wherein at least one of said plurality of lines of holding pin holes includes at least two set of holes, each adapted to a different set of pins for attachment to two different mimeograph machines by the holes in that line.

3. The improvement of claim 1, wherein only one of said lines of holes include two sets of holes, each adapted for a different mimeograph machine.

4. The improvement of claim 2, wherein there are three lines of holes with a perforated tear line between adjacent lines of holes, and one said line includes two sets of holes and each set adapted for a different mimeograph machine.

* * * * *